US005301694A

United States Patent [19]

Raymond et al.

[11] Patent Number: 5,301,694

[45] Date of Patent: Apr. 12, 1994

[54] PROCESS FOR ISOLATING PLANT EXTRACT FRACTIONS

[75] Inventors: Wynn R. Raymond, Chesterfield; Robert W. Hale, Bon Air, both of Va.

[73] Assignee: Philip Morris Incorporated, New York, N.Y.

[21] Appl. No.: 789,979

[22] Filed: Nov. 12, 1991

[51] Int. Cl.[5] ..... A24F 1/16

[52] U.S. Cl. ..... 131/297; 131/298; 131/300; 131/905; 131/199; 426/490; 426/495; 426/429

[58] Field of Search ..... 131/297, 298, 300, 301, 131/302, 194, 199, 905; 426/490, 495, 425, 429, 430, 431

[56] References Cited

U.S. PATENT DOCUMENTS

| | | | |
|---|---|---|---|
| 1,949,012 | 2/1934 | Frank . | |
| 2,805,667 | 9/1957 | Von Bethmann . | |
| 3,136,321 | 6/1964 | Davis . | |
| 3,316,919 | 5/1967 | Green et al. . | |
| 3,424,171 | 1/1969 | Rooker . | |
| 4,153,063 | 5/1979 | Roselius . | |
| 4,421,126 | 12/1983 | Gellatly . | |
| 4,506,682 | 3/1985 | Muller . | |
| 4,716,120 | 12/1987 | Tsay et al. | 436/513 |
| 4,925,690 | 5/1990 | Odake | 426/599 |
| 4,967,771 | 11/1990 | Fagg et al. | 131/297 |
| 5,074,319 | 12/1991 | White et al. . | |

FOREIGN PATENT DOCUMENTS

| | | |
|---|---|---|
| 269545 | 6/1988 | European Pat. Off. . |
| 326370 | 8/1989 | European Pat. Off. . |

*Primary Examiner*—Paul Prebilic

[57] ABSTRACT

Fractionated plant extracts, particularly essentially nicotine-free tobacco extracts, useful as tobacco flavorants and methods for preparing and using the same are described herein. These fractionated extracts are stable, non-volatile and relatively odorless under conditions of smoking article or smoking substitute article manufacture and storage, but when thermally provoked, the extracts deliver characteristic flavor to smoking articles or smoking substitute articles. The fractionated plant extracts may be prepared by contacting plant matter with a solvent to produce a crude plant extract; removing the solvent from this plant extract; and isolating a fraction of this extract that when thermally provoked provides the characteristic aroma and flavor of the plant by size exclusion chromatography and monitoring the fraction's integrity by suitable detection means.

60 Claims, No Drawings

PROCESS FOR ISOLATING PLANT EXTRACT FRACTIONS

FIELD OF THE INVENTION

This invention relates to fractionated plant extracts useful as flavorants or flavor enhancers for tobacco or other products. More particularly, this invention relates to tobacco extracts fractionated to be essentially nicotine-free and to processes for making and using the same. Specifically, this invention relates to isolated fractions of tobacco extracts having molecular weights of between about 1500 Daltons and about 5000 Daltons, and that are essentially nicotine-free. The tobacco extracts of this invention are stable, non-volatile and relatively odorless under the conditions of smoking article or smoking substitute article manufacture and storage, but under thermal conditions the extracts deliver tobacco flavors to cigarettes or to smoking substitute articles. These extracts are useful as flavoring agents and as flavor enhancers for smoking articles—e.g., cigarettes and other tobacco products—as well as smoking substitute articles.

BACKGROUND OF THE INVENTION

Consumers of smoking articles are sensitive to a variety of characteristics that contribute to a pleasurable smoking experience, including among others the aroma of the smoking article itself, the aroma and flavor of the smoke generated by the smoking article upon ignition thereof, and the "mouthfeel" created by the smoke generated by the smoking article which has been inhaled. The term "mouthfeel" refers to the impact, body and other sensations (e.g., harshness, peppery, powdery, etc.) of the smoke produced upon ignition of the smoking article and inhalation of the smoke produced therefrom in the consumer's mouth.

A variety of tobacco flavorants have been used to adjust the characteristics of smoke generated by the ignition of tobacco products. See, e.g., U.S. Pat. Nos. 3,136,321; 3,316,919; 3,424,171; 4,421,126; and 4,506,682. Ideally, a smoking article will produce relatively little or no odor during its storage, but will deliver aromatic and flavorful smoke when ignited and will confer a subjectively pleasant mouthfeel when inhaled by the consumer.

Heretofore, investigators have isolated tobacco volatiles—characterized generally as having low molecular weights—and essences of whole tobacco extracts for use as tobacco flavorants. For example, published European patent application 326 370 by Fagg refers to a two-stage extraction process said to be capable of isolating tobacco essences. The process described refers to a water extraction method where a vessel housing an aqueous solution and a predetermined amount of tobacco is initially agitated and then spray-dried to form a dry powder. A second agitative extraction is performed on this spray-dried powder with a different solvent, such as methanol or ethanol, to yield a tobacco essence upon removal of the solvent. Published European patent application 269 545 by Grossman discloses a method said to be capable of extracting components from plant tissues useful as food supplements exhibiting antioxidant capabilities by a combined aqueous extraction and chromatographic fractionation process.

In recent years, it has also become increasingly desirable to produce smoking articles with decreased nicotine content. Although flavorless by itself, nicotine possesses the ability to enhance the contributions of the tobacco components responsible for providing the tobacco's unique aroma and flavor when the smoking article is ignited.

Previously, nicotine extraction processes have employed volatile organic solvents with and without alkaline agents. See, e.g., U.S. Pat. No. 1,949,012. One such process, described in U.S. Pat. No. 2,805,667, refers to an ion-exchange chromatography system which is reported to remove nicotine from an aqueous tobacco extract. The tobacco product obtained is said to contain less than 20% of its original nicotine content. However, this and other processes known in the art have been found to be disadvantageous because not only nicotine is removed from the tobacco but other components which characterize the tobacco's aroma and flavor are also removed, thus affording a substantially lower quality tobacco. In this regard, the foregoing processes for nicotine removal compromise the natural aroma and flavor of tobacco.

There exists a need for fractionated plant extracts, especially fractionated tobacco extracts that are essentially nicotine-free, and are useful as tobacco flavorants. In that regard, it would be desirable to develop a process for producing fractionated tobacco extracts which have nicotine selectively removed without eliminating or altering other tobacco components that are responsible for tobacco's distinctive aroma and flavor. It would also be desirable for these fractionated tobacco extracts to release that distinctive aroma and flavor only upon ignition of the smoking article or smoking substitute article to which they have been applied and to be non-volatile and remain substantially inert during manufacturing and storage.

SUMMARY OF THE INVENTION

The present invention remedies the problems identified above by providing a three step process, with an optional fourth step, for producing fractionated plant extracts useful as flavorants or flavor enhancers for tobacco or other products. The first step of the process involves an extraction of plant matter by contacting the plant matter with a solvent to produce a crude plant extract. The second step of the process involves concentrating the crude plant extract. In the third step, the concentrated crude plant extract is subjected to a size exclusion process wherein the crude plant extract is fractionated to afford a series of fractionated plant extracts, and in particular, a series of intermediate molecular weight fractionated plant extracts which are non-volatile under ambient temperature conditions. When tobacco is chosen as the plant matter, essentially nicotine-free fractionated tobacco extracts are produced. The optional fourth step of the process of the invention utilizes ion-exchange chromatography to remove nicotine from the lowest molecular weight fractions of the series of intermediate molecular weight fractionated tobacco extracts which still contain nicotine after size exclusion.

Accordingly, it is an object of the present invention to provide a process for producing fractionated plant extracts, specifically fractionated tobacco extracts that are essentially nicotine-free, and which are non-volatile under the conditions at which these extracts are applied to tobacco and are non-volatile under the conditions occurring during the manufacture and storage of smoking articles and smoking substitute articles.

It is another object of the present invention for these fractionated tobacco extracts to confer tobacco aroma and flavor to the smoking article or smoking substitute article under conditions at which the smoking article or smoking substitute article is intended to be used.

These and other objects of the present invention will become readily apparent from the detailed description of the invention which follows.

DETAILED DESCRIPTION OF THE INVENTION

The fractionated extracts of the plant varieties subjected to the process of the present invention are stable, non-volatile and relatively odorless under ambient conditions. However, when these extracts are thermally provoked, they tend to deliver the natural aroma and flavor of the entire plant species from which they were obtained. The term "plant matter" is intended to refer to plant leaves, stalks, or stems, although leaves are preferred. The term "thermally provoked" is intended to refer to pyrolytic temperatures—i.e., temperatures often reached at the end of a lit tobacco product.

Without intending to be bound by theory, it is believed that the components contained within the fractionated extracts prepared in accordance with the described process are encapsulated or entrained within the structure of the host plant. Once liberated from the plant matrix, those components responsible for conferring the characteristic aroma and flavor of the plant from which they originated may be isolated by the described process.

Tobacco is composed of many individual constituents which may be arbitrarily categorized by molecular weight into three groups: high molecular weight, intermediate molecular weight and low molecular weight constituents. The high molecular weight constituents of tobacco are typically in the range of 100,000 Daltons or more. Low molecular weight constituents are typically in the range of less than 600 Daltons.

For purposes of the present invention, the intermediate molecular weight fractionated plant extracts of interest have a molecular weight within the range of from about 600 Daltons to about 100,000 Daltons, preferably within the range of from about 1,000 Daltons to about 15,000 Daltons, and most preferably within the range of from about 1,500 Daltons to about 5,000 Daltons.

These intermediate molecular weight fractionated tobacco extracts are substantially nonvolatile, odorless and stable at conditions typical for the manufacture and storage of smoking articles and smoking substitute articles and deliver the desired flavoring intensity when thermally provoked. It is contemplated and intended that these extracts may be advantageously used in conjunction with tobacco of smoking articles such as cigarette tobacco, pipe tobacco, and the like, as well as smoking substitute articles and other materials that may benefit from such fractionated tobacco extracts.

These tobacco extracts will typically deliver an enhanced tobacco flavor and improved mouthfeel to smoke produced upon ignition of the smoking article due to the thermal stability of the components in the extract. These characteristics permit the extracts to be applied to a smoking article at levels sufficient to flavor the tobacco smoke which is emitted upon the ignition of the smoking article without adversely affecting the aroma of the smoking article itself during manufacture, storage, transport or prior to the article's ignition. By neither losing potency nor affecting the aroma of the smoking article prior to its intended use, the fractionated extracts need not be overloaded on the smoking article in order to attain a desired flavoring level when the smoking article is ultimately used.

In accordance with the first step of the method of the present invention, components of the plant matter useful as flavorants may be extracted from the plant matter by percolating a solvent over and through the plant matter in any conventional solvent extraction system. When tobacco is the plant material used, components of the tobacco useful as flavorants, including nicotine, may be extracted from the tobacco by percolating a solvent over and through the tobacco in any conventional solvent extraction system. One such system uses a Soxhlet extractor having a layered bed of tobacco and inert filler.

The inert filler, preferably being substantially noncompressible, may be employed as a processing aid in the percolation bed in order to minimize bed compaction and bed channeling during the extraction processes. Any inert filler, such as excelsior, glass beads, or a combination thereof, will suffice although the preferred inert filler is oat hulls. A preferred percolation bed comprises alternating layers of tobacco and inert filler in the ratio of about 99:1 to about 80:20 tobacco to inert filler by weight, although a ratio of about 90% tobacco to about 10% inert filler by weight is particularly preferred.

The tobacco used in the process of the present invention may be whole leaf tobacco that has been cut or shredded such that a somewhat impermeable mass does not form when the percolation solvent contacts the tobacco. Preferably, the tobacco is lamina—i.e., cured tobacco leaf where the stem and midrib has been removed. The tobacco should be cut into shreds of between about 60 cuts/inch and about 10 cuts/inch, such that a large surface area may be exposed to the percolation solvent. Typically, a shred size of about 30 cuts/inch should be chosen.

Prior to preparing the tobacco for the percolation extraction, it may be advantageous to moisten the tobacco to lessen the brittleness of the tobacco leaf and decrease its potential for shattering when cut. In that regard, prior to cutting or shredding, steam may be applied to the tobacco to elevate the moisture content thereof to a suitable level. The tobacco moisture levels as used herein are measured in accordance with the method disclosed at columns 4 and 5 of commonly assigned U.S. Pat. No. Re. 32,014. Moisture levels of at least about 10% to at least about 30% may be chosen, although a level of about 12–13% is preferred. At such a preferred level, the tobacco may remain stable against chemical and microbiological activity during the storage thereof for prolonged time periods.

Once the percolation bed has been prepared, the percolation solvent may be advantageously employed to extract components from the tobacco during each pass of the solvent thereover. The percolation solvent should be used at a temperature in the range of about 4° C. to about 90° C. The degree of component extraction will vary depending on, for example, the composition of the percolation solvent, the temperature of the solvent, the rate at which the solvent passes over the tobacco-containing percolation bed and the like.

The percolation extraction process typically employs three 24-hour soak cycles, although two or four 24-hour soak cycles may be advantageously employed as well. After each cycle, the solvent may then be recycled by a pump from the solvent tank. Alternatively, sequential soak and drainage cycles may be performed, where each cycle uses fresh solvent. Continuous extraction may also be used as an alternative to soak and drain cycles, wherein fresh solvent or recycled extract may be used.

Many solvents may be used in the percolation extraction step of the process of the present invention, including, but not limited to, water, ethanol and mixtures thereof. Preferred among these solvents are water at temperatures in the range of about 20° C. to about 90° C., preferably in the range of about 75° C. to about 90° C. More preferred among these solvents are water-ethanol solvent mixtures at ambient and other temperatures. Solvent mixtures of water-ethanol in the range of about 95:5 to about 20:80 volume to volume (v/v) water-ethanol may be used, although mixtures of about 60:40 v/v water-ethanol, about 40:60 v/v water-ethanol, and about 30:70 v/v water-ethanol are particularly preferred. These water-ethanol solvent mixtures may be employed at temperatures in the range of sub-ambient temperature up to at least about 70° C., preferably in the range of about 20° C. to about 65° C., most preferably in the range of about 25° C. to about 40° C.

Percolation under the preferred conditions generally yields a crude plant extract with about a 4-7% by weight solids content. The solids content may be obtained by gravimetrically measuring the extract before and after solvent removal and drying. Upon solvent removal by any of several evaporative techniques—especially those recited below—a concentrated extract having about 12-36% by weight solids content may be obtained, although a solids content of about 18-22% by weight is preferred.

Many evaporative techniques, such as reverse osmosis, microfiltration, nanofiltration, ultrafiltration, hollow fiber diafiltration, and vacuum distillation, are suitable to concentrate the crude plant extract in the second step of the process of the present invention. Preferred among these evaporative techniques is selective reverse osmosis. For a descriptive review of these techniques and the materials generally used therewith, see the product catalogues of Amicon Division of W.R. Grace & Co. of Beverly, Mass.; Millipore Corporation, Bedford, Mass.; Membrane Products, Kiryat Weizmann Ltd., Rehovot, Israel. See also Scopes, *Protein Purification: Principles and Practice.* Springer-Verlag (1982).

When vacuum distillation is chosen as the evaporative technique to concentrate the crude plant extract it is desirable to reduce the pressure in the system to about 10 to 29 inches of Hg, with about 20 inches of Hg being preferred. Further, the temperature of the external heating means should be maintained at about 25° C. to about 90° C., with about 70° C. being preferred to effectuate solvent removal.

The concentrated crude plant extract, such as a tobacco extract from the percolation extraction process, may be adjusted to about 20° C. by a heat exchange step. This step is intended to limit the turbulence of the sample and thereby enhance the laminar flow thereof prior to subjecting the sample to any of the size exclusion techniques described hereafter. This heat exchange step is preferably employed when thermal concentration methods, such as vacuum distillation, are employed to remove the percolation solvent. If a nonthermal method of concentration, such as reverse osmosis, microfiltration, nanofiltration, ultrafiltration or hollow fiber diafiltration, is chosen as the means for removing the percolation solvent, this concern over sample turbulence is vitiated since those techniques are performed under substantially ambient conditions.

In the third step of the method of the present invention, the concentrated plant extract may be advantageously subjected to a nonthermal separation technique which fractionates the concentrated plant extract. When tobacco is the plant material used, the non-thermal separation technique which fractionates the concentrated tobacco extract is capable of creating a substantially nicotine-free tobacco extract. Preferred among the techniques for separating nicotine from tobacco extracts may be any conventional size exclusion process that separates based upon physical parameters, such as size exclusion chromatography, reverse osmosis, microfiltration, nanofiltration, ultrafiltration, hollow fiber diafiltration, or any combination thereof. Particularly preferred among these techniques is size exclusion chromatography, which, as that term is used herein, is intended to encompass both nonaqueous size exclusion chromatography (gel permeation chromatography) and aqueous size exclusion chromatography (gel filtration chromatography).

The packings for the size exclusion process, particularly for size exclusion column chromatography, should be substantially inert to the extract that is applied thereto. With respect to nonaqueous size exclusion column chromatography, the pore size of the column packings should be in the range of about 40 to about 100 angstroms, with about 40 to about 60 angstroms being preferred. Similar pore sizes should be suitable for aqueous size exclusion chromatography. The bead size of the column packing may depend upon the size of the column used. For example, when a column having about a 5 cm diameter is employed, beads of about 5 to 20 microns should be used. Preparative scale applications, on the other hand, may use a column having about a 180 cm diameter with beads of about 80 to 100 microns. For a recitation of column packings well-suited for use in the process of the present invention, see the product catalogues of Pharmacia LKB Biotechnology, Piscataway, N.J.; BioRad Laboratories, Richmond, Calif.; Amicon Division, W.R. Grace & Co., Beverly, Mass. See also Scopes, *Protein Purification: Principles and Practice,* Springer-Verlag (1982). In any event, a preferred column packing is the cross-linked dextran bead known commercially as Sephadex G-10 (having a nominal exclusion limit of approximately 700 Daltons) and supplied by Pharmacia LKB Biotechnology, Piscataway, N.J. A less preferred column packing is known commercially as Bio-Gel P2 (having a molecular weight fractionation range/nominal exclusion limit of approximately 100 to 1,800 Daltons) acrylamide gel, supplied by BioRad Laboratorres, Richmond, Calif.

Any of a variety of solvents—i.e. aqueous, organic, or a combination thereof—may be used as an elution solvent in size exclusion chromatography. This solvent not only serves as a dissolution medium but also transports the extract sample through the column. To that end, preferable solvents include water, dilute salt solutions (ionic strength $\geqq 0.02$ M) and other solvents that are capable of solubilizing the tobacco extract. Particularly preferred among these solvents is water. Salt solutions, while desirable to minimize ion exchange between solutes and column packing media, are not preferred for the present invention because of the need for subsequent salt removal to prevent undesirable subjective effects.

The elution solvent should pass through the column at a rate of about 60 ml/min to about 120 ml/min, with about 75 ml/min being preferred for a 25.2 cm diameter column. The flow rate for columns with diameters other than 25.2 cm may be calculated linearly from the flow rates given for the 25.2 cm diameter column. The flow rate may be controlled manually or automatically. Similarly, the pump speed for the size exclusion chromatography column and, if used, the switching value for the ion-exchange system may be controlled manually or automatically by a digital control system.

It is preferred that during fractionation of tobacco extract, the temperature be kept in the range of at least about 4° C. to about 35° C. Ambient temperatures—e.g., about 20° C. to about 27° C.—are particularly preferred because, although elevated temperatures theoretically result in improved solute diffusion into the gel resulting in improved resolution, in the present invention, better resolution is obtained when fractionation is operated at ambient temperatures. In addition, ambient temperature operation is more economical.

Prior to subjecting the concentrated crude plant extract to any of the size exclusion techniques described herein, it may often be advantageous to remove insoluble material, such as residual solids and waxes, from the concentrated extract. In particular, the presence of insoluble material in the concentrated crude plant extract may plug the column bed thereby impeding the flow of the sample through the column. (When the concentrated tobacco extracts described herein were subjected to cold storage, e.g., about 4° C. for a period of about 72 hours, some degree of precipitation of flocculent proteinaceous solid and wax separation was exhibited.)

In an attempt to minimize this event, a guard column may be provided for the size exclusion chromatography column. Although many guard columns are available, one that is packed with the size exclusion resin that is employed in the main column is preferred. For example, if a Biosil TSK-250 column (supplied by BioRad Laboratories, Richmond, Calif.) is employed for the separation, then a Biosil TSK guard column (also supplied by BioRad Laboratories) may be advantageously introduced therewith. For low performance size exclusion, a disposable in line nylon liquid filter (0.3 μm) may be used (i.e., Cole Parmer #L-02909-60).

The concentrated crude plant extract may also be subjected to various techniques for removing the insoluble materials, such as centrifugation and/or filtration or sequential chilling, precipitation and decantation. Preferably, the concentrated crude plant extract may be subjected to chilling, followed by centrifugation so that the insoluble materials are driven toward the bottom of the centrifugation vessel. The liquid extract may then be decanted from the vessel substantially free from these insoluble materials and subjected to polishing filtration such as passing through a filter pad, such as a Fisher G2 or Whatman GF-B glass fiber filter pad, to provide a clear finished filtrate. At this point, the finished concentrated crude plant extract may be subjected to any of the size exclusion processes described herein or stored for later processing. If storage is chosen, a reduced temperature, such as a temperature of about 4° C., is preferred.

After the extract sample has passed through the size exclusion process, fractions may be taken by various methods, including randomly, by a timed method, or by utilizing a detection means to detect when the fractions of interest have been eluted. Methods using determinations by time with respect to eluant flow rate or, alternatively, using detection means with respect to the appearance of a specific physical parameter are preferred methods by which fractions of interest may be recovered. Regulated fraction cutting may also be advantageously employed, such as where fraction cutting is regulated by a digital controller using a UV detector to detect components passing therethrough based on their UV absorbance.

The integrity of the fractions obtained from the size exclusion step may be determined by monitoring the flow of the eluant by any suitable detection means. A detection means capable of observing changes in the distribution and intensity of the substance sought to be detected may be used to detect that substance in the described preferred modes. Preferred detection means include methods which rely, at least in part, upon absorptive, fluorescence, reflective or diffractive phenomena, as well as pH and electrochemical conductance, which may be triggered by the presence of the substance of interest. A detection means responding to the appearance or attainment of a particular ultraviolet (UV) absorbance, infrared (IR) absorbance, refractive index (RI), circular dichroism (CD) value, light scattering, mass detection observation, pH or electrochemical conductance value, or any other qualitative or quantitative detection means may be advantageously employed in the process of the present invention. A tandem detection means may be advantageously employed where the tandem detection means may be, for example, UV set at two distinct wave lengths such that components of the extract that elute from the size exclusion process may be selectively detected in view of the different absorption spectra often exhibited by many chemical entities. Or, a combination of UV and CD linked in series may be engaged as a detection means. Further, tandem detection means may also be particularly advantageous when the molecular dimensions and molecular weight of the components in a desired fraction of an extract are to be determined. CD is particularly useful in the case of tobacco extracts because of its utility in detecting the presence of nicotine in the eluate.

Following elution of the extract sample, the apparatus used in the size exclusion process should be cleaned with an alkali wash—preferably, about 0.5 M NaOH—and then regenerated with water, preferably deionized water. In this manner, the reproducibility of the extract fractions may be retained and the life of the size exclusion media may be increased. The wash may be commenced at about the halfway point through the run and a pH meter or an electrochemical conductance meter may be employed individually, or in tandem, to determine when the alkali wash begins to elute from the column.

In the optional fourth step of the process, those fractions that are determined to contain nicotine may be collected from the size exclusion step and thereafter subjected to cation-exchange chromatography to further remove nicotine from the fractionated extract. In that regard, eluate from the size exclusion step containing nicotine may be applied directly onto an ion-exchange chromatography column with or without first being concentrated. A switching valve, triggered by the detection of nicotine by one of the detection means recited above such as CD, may accomplish the latter. In another mode of the ion-exchange step, the nicotine-containing fractions from the size exclusion process may be advantageously processed in a batch method to remove any nicotine.

Many ion-exchange chromatography media are suitable for this purpose. For a descriptive recitation of ion-exchange resins, see, e.g., the product catalogues of BioRad Laboratories; Pharmacia LKB Biotechnology; EM Science, Gibbstown, N.J.; Supelco Separations Technologies Group, Div. of Rohm & Haas, Bellefonte, Pa. Carboxymethyl Sephadex C-25 supplied by Pharmacia LKB Biotechnology is a preferred medium for this application due to its higher cation exchange capacity than most resin based exchange media and because it is less likely to contribute subjectively unacceptable resin monomers to the effluents. Carboxymethyl Sephadex C-25 is a microporous bead-formed cation exchanger comprising a cross-linked dextran gel having carboxymethyl substituent groups and has a molecular weight fractionation range/nominal exclusion limit of approximately 100 to 5,000 Daltons. Other suitable ion-exchange materials include 1) dextran gel having sulfopropyl substituent groups, 2) cellulose having carboxymethylcellulose substituent groups, 3) polystyrene having sulfonic acid substituent groups (Dowex 50® available from Dow Chemical USA or Amberlite® IRC-84 available from Rohm and Haas Co.) and 4) polystyrene having carboxylic acid substituent groups.

The eluant typically chosen for ion-exchange separations may be a buffered aqueous solution which contains a counter ion whose charge is opposite to that of the charged groups found attached on the resins but which is present in a charge equilibrium with the resin in the form of an ion pair; put another way, the counter ion will normally possess the same charge as the material desired to be isolated from the sample that is applied to the column. Suitable eluants for the ion-exchange process include citrate, succinate or phosphate. Preferred among these eluants is phosphate.

Although a buffered solution may be used in the ion-exchange step of the present invention, it is often not necessary to include an additional buffer in order to effectuate a satisfactory separation. The samples which are to have their nicotine removed tend to exhibit a degree of "self-buffering" in that the components of the sample to be purified exhibit the traditional ion-exchange phenomena without the addition of a buffer. Moreover, the addition of a buffer to the extract sample may impart undesirable aromas and flavors to the fractionated extract destined for use as a flavorant. Further, the addition of a buffer may necessitate its removal prior to using the fractionated extract in order to ensure that the eluted extract retains its desired characteristics.

Suitable means for detection for the ion-exchange step are similar to those detection means described hereinabove for the size exclusion process. Nonetheless, a UV detector, such as an ISCO UA-5 monitor (supplied by ISCO, Lincoln, Nebr.) is preferred.

Whether or not the optional fourth step of the process is utilized, it is desirable to concentrate the recovered fractionated plant extract or extracts. This concentration may be accomplished in any of several ways, including reverse osmosis, microfiltration, nanofiltration, ultrafiltration, hollow fiber diafiltration, vacuum distillation, and freeze drying. Selective reverse osmosis is preferred.

Once concentrated, the fractionated plant extracts of the present invention may be advantageously applied to products designated for many uses. For example, prior to smoking article preparation, the fractionated extract may be sprayed onto the tobacco filler to be used in the smoking article. Or, the tobacco filler may be dipped into a dilute solution of the fractionated extract and thereafter dried to an acceptable moisture level. A sample of the extract may also be injected into the smoking article or smoking substitute article after it has been assembled.

The processes of the present invention may be advantageously employed with individual tobacco varieties, such as Flue-Cured, Turkish, Md., and Burley, or with any combination thereof to create essentially nicotine-free tobacco extracts which may be applied to any of the above-noted tobacco varieties or any combination thereof.

Higher and lower molecular weight components of tobacco may also be processed by the separation techniques disclosed herein. However, it will be clear to one of skill in the art that engaging a size exclusion medium with a different pore size may be necessary to achieve substantially the same results as with the intermediate molecular weight tobacco extracts of the present invention which are essentially nicotine-free. It will also be readily appreciated that without undue experimentation some manipulation of the parameters of the disclosed process may be necessary to prepare fractionated tobacco extracts of dissimilar molecular weight ranges.

While the present invention is described in detail primarily with respect to fractionated tobacco extracts, particularly fractionated tobacco extracts that are essentially nicotine-free, the disclosed processes may be advantageously used to prepare fractionated extracts from any plant variety that may deliver a distinctive aroma and flavor often, but not always, characteristic of the plant from which it originated. Plant varieties other than tobacco which may be used to prepare fractionated extracts include herbs, spices, oleo resins, and fruits. More specifically, the preparation of fractionated extracts of cocoa and coffee that are caffeine-free or fractionated extracts of sage, fennel, cinnamon, St. John's bread, foenugreek and the like are contemplated by the described process. Similarly, any of these fractionated plant extracts may be used in a likewise manner to that contemplated by the disclosed essentially nicotine-free tobacco extracts. Of course it will be readily understood by one of ordinary skill in the art that certain obvious modifications may be necessary that do not require undue experimentation in order to accomplish the stated goals for the particular plant variety chosen.

The following examples are provided for the purposes of further illustration and are in no way intended to limit the scope of the present invention.

EXAMPLES

Although the experiments described below focus on Flue-Cured and Burley varieties of tobacco, other tobacco varieties may be processed by the method of the present invention. Moreover, fractionated extracts of tobacco blends may also be prepared by the described process. In addition, many fractionated plant extracts, such as sage, fennel, cinnamon, cocoa and coffee extracts, may also be prepared by the described process.

EXAMPLE I

A. Tobacco conditioning Prior To Extraction

Tobacco lamina was treated with steam to adjust moisture content to a suitable level for cutting and shredding. In order to process the tobacco, moisturization is preferred prior to processing in order to lessen the brittle nature of the tobacco leaf and thereby decrease the opportunity of shattering the leaf and the creation of tobacco waste. The moisture content of the tobacco at cutting was at a level of about 22%. The tobacco was shredded at 60 cuts/inch and then dried to a moisture content of about 12–13%.

B. Tobacco Extraction

The tobacco extraction was performed with a large-scale Soxhlet extractor having the following components: A 20 gallon roundbottom two-neck boiling flask functioned as a pot; a Soxhlet head having a length of 53 cm and an inside diameter of 19.5 cm with about a 15.8 liter total volume; and an Allyn condenser with a tap water cooling mechanism placed above the pot.

A tobacco charge of about 5 pounds was used for the extractions and this tobacco charge was packed into the extractor to a bed depth of about 48 cm. Two types of extractions were performed: (1) a solvent percolation extraction using the Soxhlet head as the percolation vessel; and (2) conventional Soxhlet extraction where the extracting solvent was distilled, condensed onto the tobacco in the extractor head, and periodically returning to the solvent vessel.

1. Hot Water Soxhlet Extraction

The Soxhlet head was charged with the cut and shredded tobacco. A perforated aluminum distribution plate was thereafter placed on the top of the bed of tobacco leaf. Deionized water was then introduced into the Soxhlet head in a quantity sufficient to substantially cover the tobacco bed and fill the Soxhlet siphon tube to a level about just below the siphon point. The pot was then charged with about 1 gallon of deionized water. After allowing the tobacco bed to soak for a period of about 16 hours at room temperature (i.e., about 35° C.), the pot was heated to a temperature of 85°–87° C. using a heating mantle. The water from the pot was continuously circulated to the top of the tobacco bed using a peristaltic pump at a circulation flow rate of about 200 ml/min. After circulating the solvent for a period of about 8 hours, the bed was drained and the extract was collected from the pot.

The use of hot water for the extraction afforded a physically degraded tobacco leaf which in turn resulted in bed compaction. Consequently, this extraction process was rendered incomplete and the recovered extract was not fractionated.

2. Water-Ethanol Soxhlet Extraction

The Soxhlet head was charged with the cut and shredded tobacco by the procedure described in I(B)1, above, but placing the perforated aluminum distribution plate on top of the bed of tobacco leaf was omitted. The condenser was fitted to the top of the Soxhlet head and the pot was charged through the side neck of the Soxhlet with about 5 gallons of percolation solvent which comprised about 70% aqueous ethanol (v/v). The side neck was stoppered, the water for the condenser was turned on and the pot was heated to a temperature of about 85°–87° C.

The pot distillate continuously condensed onto the tobacco bed as the temperature was maintained at about 85°–87° C. and the Soxhlet extract returned to the pot periodically as the siphon filled. The solvent was permitted to reflux for a period of about 8 hours and the bed was then allowed to soak overnight—about 16 hours—without refluxing the solvent. This reflux/soak cycle was repeated three times followed by a final 4 hour reflux. The total extraction time period was about 3.5 days.

The pot was then allowed to cool to about room temperature and then the extract was drained from the tobacco bed back into the pot through a drain port in the bottom of the Soxhlet head over a period of about 2 hours. The temperature of the condensed distillate contacting the tobacco was about 35° C. The final extract—about 5 gallons—was filtered through Whatman #1 filter paper (supplied by Whatman, Clifton, N.J.) by gravity and the filtrate obtained was concentrated to a volume of about 1 gallon by rotary evaporation at aspirator vacuum (i.e., about 12 inches of Hg) with the bath temperature of the rotary evaporator (Büchi, Sybron/-Brinkmann, Westbury, N.Y.) being about 55° C. Thus, during the concentration of the percolation extract sample, ethanol was nearly quantitatively stripped along with about 0.5 gallon of water which resulted in an aqueous concentrate with only a trace amount of residual ethanol.

3. Water-Ethanol (30:70 v/v) Ambient Temperature Percolation Extraction

The Soxhlet head was charged with cut and shredded tobacco and the distribution plate was introduced on top of the tobacco bed as described in I(B)1, above. A 30:70 water-ethanol (v/v) percolation solvent was introduced into the Soxhlet head in an amount sufficient to cover the tobacco bed and to fill the siphon tube to just below the siphon point. Then approximately 0.5 gallons of the same solvent was added into the pot.

After allowing the tobacco bed to soak for a period of about 16 hours, the percolation solvent was continuously circulated from the pot to the top of the tobacco bed via peristaltic pumping at a rate of about 200 ml/min. The pot was not heated and thus the temperature remained at about 25° C. The percolation solvent continued to circulate for a period of about 8 hours after which time the contents of the Soxhlet were drained into the pot and the contents thereof were collected. The tobacco bed, which had compacted slightly, was then adjusted to its original bed depth (i.e., about 48 cm) and percolation solvent was added to the Soxhlet head.

The soak/circulation cycle was then repeated for two additional runs using a total of about 5 gallons of solvent for the three cycles over about a three day total extraction period. The combined extracts from the three cycles were filtered and then concentrated to a volume of about 1 gallon as described in Example I(B)(2).

4. Water-Ethanol (50:50 v/v) Ambient Temperature Percolation Extraction

Extractions of tobacco according to the same procedure cited in Example I(B)(3) were performed using 50:50 water-ethanol (v/v) as the percolation solvent. The resultant extract was concentrated in the same manner as in Example I(B)(3).

Each of the percolation extractions in the tobacco extracts yielded similar total solids contents; that is, for Burley tobacco, the total solids recovery was about 12.0–12.5% (w/w) and for Flue-Cured the total solids recovery was about 16.5–8.0% (w/w).

EXAMPLE II

A. Sample Preparation Prior To Size Exclusion Fractionation

When placed under cold storage conditions (i.e., 4° C.) the tobacco extracts exhibited some degree of precipitation of flocculent proteinaceous solids and wax separation. While separated solids and waxes together represented only about 10–20 grams per gallon of extract, they were present in sufficient quantity to plug the column bed when the extract was applied thereto. Therefore, a substantial amount of the insoluble material was removed prior to introducing the sample onto the gel filtration system.

The tobacco extracts were centrifuged to substantially remove both precipitated solids and waxes. After centrifugation, the extract concentrate was carefully decanted into a large 60° glass funnel with a 20 cm Whatman #1 fluted filter (supplied by Whatman, Clifton, N.J.) for gross solids and wax removal by gravity filtration. The desludged filtrate was then polished by suction filtration using a Büchner funnel fitted with a Fisher G2 (formerly C9CM) glass fiber filter pad (supplied by Fisher, Pittsburgh, Pa.) to afford clear finished filtrate.

This finished filtrate was weighed into a tared flask and transferred quantitatively into the loading vessel in preparation for the size exclusion chromatography process. A 2 liter separatory funnel was used as the loading vessel to load about 900 grams (about 2 pounds) of the tobacco extract onto a gel filtration chromatography column.

B. Gel Filtration Equipment

A BioProcess column (Pharmacia Fine Chemicals, Piscataway, N.J.) having a diameter of 25.2 cm and a length of 135 cm was used to effect the extract fractionation. This column had a total bed volume of about 67 liters. This column was packed according to the standard manufacturer's instructions with a cross-linked dextran size-exclusion medium, commercially known as Sephadex G-10 (Pharmacia Fine Chemicals, Piscataway, N.J.), having a size distribution of about 40–120 micron beads.

In conjunction with the column, a C-3 Sephamatic Digital Controller (Pharmacia Fine Chemicals, Piscataway, N.J.) equipped with a flow meter and a pump controller was used to control the system using peak detection. The gel filtration system was automated via solenoid valves and sensors operated by the controller programs in order to ensure highly reproducible operation. A Watson-Marlow single-head peristaltic pump (Watson-Marlow, H. Wood Bacon, Inc., Concord, Mass.) was used for the inlet pump with a remote control interface to the controller.

An ISCO UA-5 UV-visible monitor (ISCO, Lincoln, Nebr.) equipped with a preparative flow cell having an adjustable window set to a path length of 0.25 mm was used in order to detect material eluting from the column. Column effluent was monitored at a wavelength of 254 nm against a reference cell of the same path length, filled with deionized water, set at the same wavelength. The sensitivity of the detector was adjusted based on the sample concentration and peak detection efficiency. The UV monitor was interfaced directly to the controller for peak detection.

The following detectors have been used as alternatives to the ultraviolet system, or as additional means for detection:

1. An inline pH detector from Pharmacia, Piscataway, N.J., to monitor column regeneration;
2. An inline electrochemical conductivity monitor (Cole-Parmer, Chicago, Ill.) to measure effluent ionic strength (particularly during and after regeneration); and
3. A custom-designed circular dichroism (CD) monitor (Hinds International, Hillsboro, Oreg.) to specifically monitor for the presence of nicotine.

Our peak collection was automated with a preparative fraction collector (Pharmacia Fine Chemicals, Piscataway, N.J.) operated by the controller.

C. Standard Gel Filtration Fractionation Of Burley Tobacco Extract

A Burley tobacco extract concentrate that we prepared according to Example I(B)(4) was filtered through a Fisher G2 filter and about 1050 grams of clear extract was obtained. All but 100 grams of this extract was then transferred to the loading vessel as described above in Example II(A).

This 100 gram portion of the clear tobacco extract was freeze-dried in a Virtis Freezemobile 24 (The Virtis Company, Gardiner, N.Y.), and was found to contain about 12.0% total solids (w/w). The solids determination procedure is as follows: About 100 g of tobacco extract is accurately weighed (to 0.1 g) into a tared 600 ml lyophilization jar (a heavy-walled vacuum jar with a vacuum-tight lid and connector to a vacuum manifold of the freeze dryer). The jar is sealed and the liquid contents frozen onto the jar walls by slow rotation of the jar in a −60° C. methanol bath (called shell freezing). The freeze-dryer condenser is turned on and allowed to equilibrate to −60° C. Then the vacuum pump is turned on and the system evacuated to a pressure of about 50 microns. The jar and its frozen contents are connected to the vacuum manifold and the manifold valve is opened, evacuating the jar. Vacuum is maintained until the soluble solids are dry. This is indicated when ice no longer is evident on the external surfaces of the lyophilization jar. After vacuum release, the jar is removed from the freeze-dryer manifold and reweighed. Solids are determined by subtracting the jar tare weight from the total weight. Percent solids are calculated as (wt. dry solids/extract weight)×100.

A similar analysis provided that the total extract solids represented 20.0% of the starting tobacco weight.

The clarified extract was analyzed by gas chromatography using a Hewlett-Packard 5890A Gas Chromatograph (Hewlett-Packard, Avondale, Pa.) with a Restek Stabilwax-DB capillary (30 meter length, 0.25 mm I.D.) column (Restek, Bellefonte, Pa.) and determined the nicotine content to be about 1.42% by weight.

The sample (901 grams) was pumped onto the column bed using the Watson-Marlow pump (Watson-Marlow, H. Wood Bacon, Inc., Concord, Mass.) with a descending flow rate of about 60 ml/min. As the loading vessel neared empty, the residual extract was washed from the vessel walls with small aliquots of deionized water. Once all of the sample had been placed on the column, the column was eluted with deionized water at a rate of about 60 ml/min. The elution was continued until the first two peaks eluting from the column were detected by UV at 254 nm and collected in separate collection vessels. The peak detection threshold on the controller was set to the minimum—i.e., 1% of the UV full scale signal—and valley detection was activated.

Upon detection of the third eluting peak, which contained nicotine, the flow rate was increased to about 200 ml/min and about 5 liters of regenerant—0.5 M NaOH—was introduced onto the column. The column was then washed with deionized water at the rate of about 200 ml/min until the effluent pH reached about neutrality and/or electrochemical conductivity decreased to about 12.00 microSiemens or less. A total wash volume of about 210 liters was used to achieve this level of regeneration. One complete fractionation/regeneration cycle lasted for a period of about 24 hours.

The contents of each collection vessel was mixed and a 10 ml aliquot was then removed from each vessel for gas chromatography analysis for nicotine using a Hewlett-Packard 5890A Gas Chromatograph. The contents of collection vessels containing Peak 1 and Peak 2 were quantitatively transferred to separate tared metal trays. These samples were then freeze-dried using a Virtis Freezemobile 24; sample frozen to −50° C.; freeze dried under vacuum of <100 microns; shelf temperature=15° C.

After the freeze-drying process was complete, the weight of the total solids content of these peaks was determined. About 14.6 grams was recovered from Peak 1 and about 23.3 grams from Peak 2 affording a total recovery from Peaks 1 and 2 of about 37.9 grams. This recovery represented about 35.1% of the total extract solids introduced onto the column and about 7.0% of the starting tobacco weight.

No nicotine was detected in the collected fractions corresponding to either Peak 1 or Peak 2 using a Hewlett-Packard 5890A Gas Chromatograph. The total nicotine measured in the remaining collected effluent accounted for about 99.9% of the nicotine in the starting sample. Elemental analysis, provided by a contract laboratory (Galbraithe Laboratories, Knoxville, Tenn.) established rough empirical formulae for the Burley tobacco peaks as follows: Peak 1, $C_9H_{10}O_4N$ and for Peak 2, $C_{15}H_{18}O_9N$. Burley Peak 1 was determined to contain the following approximate percentages of components: 36% polyphenols, 11% protein, 12% anhydrogalacturonide, 8% neutral carbohydrate, 13% water and 14% ash. Burley peak 2 was determined to contain the following approximate percentages of components: 3.5% protein, 10% anhydrogalacturonide, 4.5% neutral carbohydrate, 10% water and 31% inorganic matter (i.e., ash).

2. Standard Gel Filtration Fractionation Of Flue-Cured Tobacco Extract

Flue-Cured tobacco extract concentrate that was prepared according to Example I(B)(4) was filtered through a Fisher G2 filter and about 1010 grams of clear tobacco extract was obtained. 900.2 grams of this extract was fractionated in the same manner as described in Example II(B)(1). The starting tobacco extract (100 g) was determined to contain about 17.9% total solids by weight and about 1.3% nicotine by weight. Peak fractions were collected and sampled for their nicotine content. Then each sample was freeze-dried as described in Example II(B)(1).

The recovery of solids from Peaks 1 and 2 after the freeze-drying process was about 16.8 grams and about 28.6 grams, respectively, or about 45.4 grams combined total solids recovery. Total Peak 1 and 2 recovery represented about 28.2% of the total extracted solids loaded onto the column and about 8.4% of the starting tobacco weight.

Using a Hewlett-Packard 5890A gas chromatograph, no nicotine was detected in Peak 1 although a trace—less than about 0.001 mg/ml—was detected in Peak 2. The remaining collected effluent accounted for about 81.5% of the nicotine present in the starting tobacco extract.

Flue-Cured Peak 1 was determined to contain the following approximate percentages of components: 31% polyphenols, 9% protein, 21% anhydrogalacturonide (i.e., pectic material), 12% neutral carbohydrate, 12% water and 10% ash. Flue-Cured Peak 2 was determined to contain the following approximate percentages of components: 6% protein, 15% anhydrogalacturonide, 6% neutral carbohydrate, 11% water and 27% inorganic matter (i.e., ash). Elemental analysis established rough empirical formulae for the Flue-Cured Peak 1, $C_{14}H_{17}O_8N$ and for the Flue-Cured Peak 2, $C_{15}H_{18}O_9N$.

EXAMPLE III

Molecular Weight Determination

Molecular weights were determined by aqueous high performance gel permeation chromatography (GPC) using a BioRad Biosil TSK-250 column (300 mm×7.5 mm diameter). A Biosil TSK guard column was used to protect the GPC column. Peaks were detected by a refractive index detector which responds to mass. A 0.02 M $KH_2PO_4$/0.05 M $Na_2SO_4$ buffer (pH 6.8) was used as the mobile phase. Buffer, column and detector were maintained at 35° C. Mobile phase flow was 1 ml/min. A Nelson Analytical data system was used with GPC software to process the data. The column was calibrated with three different sets of standards, globular proteins, monodisperse pullulans and monodisperse polyethylene glycols. Best curve fits were determined by the GPC software for each set of standards (Log molecular weight vs. retention time). Tobacco fraction samples (0.2 mg each dissolved in a 0.5 ml aliquot of mobile phase) were run under the same conditions, using each standard calibration curve. Based on comparative calibration results and original gel filtration fractionation data, the polyethylene glycol standard curve was found to be most representative of the true molecular weight range of the tobacco fraction samples and was used for all further analyses. Based on GPC peak retention time and peak shapes, using standard calibration data, the Nelson GPC software calculates four values:

Molecular Weight—The molecular weight at the peak apex, representative of the molecular weight most prevalent in the peak.

2. $M_W$—Weight Average Molecular Weight—Basically the mass of the sample in grams divided by cumulative weights of all molecules present in the distribution.

3. $M_n$—Number Average Molecular Weight—Basically the mass of the sample in grams divided by the total number of molecule chains present in the distribution.

4. Polydispersivity—$M_w/M_n$—A measure of the breadth of the polymer molecular weight distribution. If the ratio of $M_w$ to $M_n$ is equal to unity, the system is said to be monodisperse, or essentially a single molecular species.

The $M_w$ values determined for the tobacco fractions cannot be regarded as absolute because comparison to molecular weight standards must take into account molecular shape (globular vs. straight chain, for example) as well as molecular size. Since molecular shape is unknown for the tobacco fractions, one must compare them to several types of standards of known shape and estimate unknown shape by curve fitting and other techniques. In this case, the polyethylene glycol standards appeared to be closest in behavior to the tobacco materials. The molecular weights cited are estimated to be within ±20% of actual.

The Peak 1 fractions from both Burley and Flue-Cured tobacco were demonstrated to have weight-average molecular weights of about 4500–4700 Daltons and polydispersivity values of about 1.1–1.2. Thus, the Peak 1 materials appeared to be substantially unimolecular—that is, within experimental error, the peak seemingly contained a single chemical species. Peak 2 materials had molecular weights of about 1500–1600 Daltons with polydispersivity values of about 1.5–2.0, indicating that more than one chemical entity was probably present.

EXAMPLE IV

Sensory Properties Of Peaks 1 and 2 From Burley And Flue-Cured Tobacco Extracts Standard 85 mm length cigarettes with standard filters and constructions to achieve the desired tar deliveries were used. Cigarettes for testing included three tar delivery ranges: 2–4 mg, 6-8 mg and 11–12 mg. Tobacco blends that were representative of conventional United States blends were used. Prior to flavor application, cigarettes were selected by weight, resistance to draw, and filter dilution in order to eliminate variability from these factors.

Initially, 2–4 mg tar delivery cigarettes were used. 10% (w/v) solutions were prepared by dissolving each peak in 50% aqueous ethanol. These solutions were applied to the center of the cigarette rod by microsyringe injection to achieve tobacco add-on levels of about 30, 60, 90 and 120 ppm. Controls were prepared by injecting comparable volumes of 50% aqueous ethanol. The injected cigarettes—test samples and controls—were allowed to equilibrate in open jars under laboratory conditions—about 25° C. and about 65% relative humidity—for a period of about 48 hours prior to testing.

Each test cigarette was presented versus the control to a panel of eight persons in a blind, balanced, paired comparison format—i.e., coded cigarettes with 50% of the panelists smoking the control cigarette first. The panelists were requested to describe any differences between the test sample and control cigarettes and choose the preferred cigarette. The panel results are summarized below:

A. All fractionated tobacco extracts that were evaluated were determined to be sensorially detectable at all application levels. The optimum application range was determined to be 60–90 ppm for 2–4 mg cigarettes. The sensory response for the panel members increased with increasing fractionated extract application level.

B. Within the 60–90 ppm application range, the Burley and Flue-Cured tobacco test cigarettes injected with the Peak 1 fraction were significantly preferred over the controls—averaging 7 of 8 panelists. Those cigarettes that were injected with the Peak 2 fraction were also preferred over the controls.

C. Peak 1 test cigarettes were described by the panelists as having enhanced mouthfeel and tobacco taste characteristics relative to the control cigarettes whereas Peak 2 test cigarettes were described by those panelists as having enhanced tobacco taste with minimal mouthfeel enhancement. These descriptions of taste and mouthfeel of Burley and Flue-Cured Peak 1 cigarettes indicated that these materials imparted sensory characteristics of the respective tobaccos from which they were derived. Similarly, Peak 2 cigarettes were described as having tobacco taste characteristics similar to the respective starting tobaccos. Other panelist comments indicated that the test cigarettes were perceived as being higher tar cigarettes than the controls, having increased response, body and balance as well as richer tobacco taste.

EXAMPLE V

Sensory Properties Of Peak 1 From Burley/Flue-Cured Tobacco Blends

Burley/Flue-Cured Peak 1 blends were also tested as described above in Example IV. The test cigarettes were described as having enhanced blended tobacco taste and mouthfeel. The nature and degree of blended character could be varied by adjusting the ratio of Burley to Flue-Cured Peak 1 materials used as well as the total cigarette application level. The blend ratio can vary from 25:75 to 75:25.

Peak 1 materials were tested at the same levels on cigarettes that were flavored as conventional cigarettes in several tar delivery ranges. The results of these tests indicated that these materials were compatible with other flavors and provided the same enhancements observed with unflavored cigarettes. Flavored cigarettes were injected as previously described in Example III. Also for these studies, 15–30 pound batches of filler were sprayed with 50% aqueous ethanol solutions of the fractionated tobacco extracts and additional flavors typically used in the cigarette manufacturing process.

The overall sensory amplitude of these materials as isolated appears to be on the order of 100–1000 greater than their effect in the original tobacco. For Example in the case of Burley Peak 1 fraction, the solids yield is 2.7% of starting tobacco by weight or 12.26 g Peak 1 material per one pound of tobacco. At a usage level (reapplied to tobacco) of 100 ppm (0.10 g/1000 g), that 12.26 g of Peak 1 material will flavor 122,600 g or 270 pounds of tobacco. At 30 ppm, that 12.26 g will flavor about 900 pounds of tobacco.

Although the foregoing invention has been described in some detail by way of illustration and examples, it will be clear that certain changes and modifications may be practiced within the scope of the appended claims. Thus, those of skill in the art will readily recognize and be able to ascertain with no more than mere routine experimentation that many equivalents exist to the specific embodiments of the present invention described herein. Therefore, such equivalents are intended to be encompassed within the scope of the present invention.

What we claim is:

1. A process for producing and isolating intermediate molecular weight fractions from plant extracts, which fractions are substantially non-volatile and stable under ambient temperature conditions and are useful as flavoring agents, comprising:

(a) contacting plant matter with a solvent to produce a crude plant extract;

(b) concentrating said crude plant extract;

(c) subjecting said concentrated crude plant extract to a size exclusion process to provide intermediate molecular weight fractions having a molecular weight in the range from about 600 Daltons to about 100,000 Daltons, wherein said size exclusion process separates on the basis of a physical parameter to provide the intermediate molecular weight fractions; and (d) isolating said intermediate molecular weight fractions by using a detection method to monitor changes in the distribution and intensity of the substances eluted in said size exclusion process.

2. The process according to claim 1, wherein said detection method employs a detection means selected from the group consisting of ultraviolet absorption, infrared absorption, refractive index, light scattering, circular dichroism, pH, and electrochemical conductance.

3. The process according to claim 1, further comprising the step of (e) concentrating said intermediate molecular weight fractions.

4. The process according to claim 1 wherein said plant matter is tobacco.

5. The process according to claim 4 further comprising the step of (e) contacting said intermediate molecular weight fractions from step (d) which contain nicotine detectable by suitable detection means with an ion-exchange material to essentially remove the nicotine.

6. A process for producing and isolating intermediate molecular weight fractions from tobacco extracts, which fractions are stable and non-volatile under ambient temperature conditions and are useful as flavoring agents, comprising:

(a) contacting tobacco with a solvent to produce a crude tobacco extract;

(b) concentrating said crude tobacco extract;

(c) subjecting said concentrated crude tobacco extract to a size exclusion process wherein said concentrated crude tobacco extract is fractionated into a series of fractionated tobacco extracts including said intermediate molecular weight fractions;

(d) isolating said fractionated tobacco extracts into fractions including said intermediate molecular weight fractions by using a suitable detection method to detect when said intermediate molecular weight fractions have been eluted from said size exclusion process and to trigger a fraction collection means in order to collect said isolated intermediate molecular weight fractions as subfractions;

(e) concentrating said intermediate molecular weight subfractions; and (f) optionally contacting said subfractions from step (d) which contain nicotine detectable by suitable nicotine detection means with an ion-exchange material to essentially remove the nicotine.

7. The process according to claim 6, wherein said detection method employs a detection means selected from the group consisting of ultraviolet absorption, infrared absorption, refractive index, light scattering, circular dichroism, pH, and electrochemical conductance.

8. The process according to claim 7, wherein said detection means is a combination of ultraviolet absorption and circular dichroism.

9. The process according to claim 1, wherein said plant matter comprises matter selected from the group consisting of leaves, stalks, stems, seeds, roots and petals.

10. The process according to claim 1, wherein said plant matter is selected from the group consisting of tobacco, cocoa, coffee, sage, fennel, licorice, cinnamon, foenugreek and any mixture thereof.

11. The process according to claim 4, wherein said tobacco is selected from the group consisting of Flue-Cured, Maryland, Burley, Turkish, and any mixture thereof.

12. The process according to claim 11, wherein said tobacco is cut into sizes of about 10 to about 60 cuts per inch.

13. The process according to claim 12, wherein prior to cutting said tobacco, said tobacco is moistened to a level from about 10% to about 30%.

14. The process according to claim 13, wherein said tobacco is moistened to a level from about 12–13%. )

15. The process according to claim 6, wherein said fractioned tobacco extracts contain essentially no nicotine.

16. The process according to claim 1, wherein said plant matter is mixed with an inert filler.

17. The process according to claim 16, wherein said inert filler is a member selected from the group consisting of excelsior, glass beads, oat hulls, and any combination thereof.

18. The process according to claim 17, wherein said inert filler is oat hulls.

19. The process according to claim 16, wherein said plant matter and inert filler are present in the ratio of about 90% plant matter to about 10% inert filler.

20. The process according to claim 1, wherein said solvent is selected from the group consisting of water, ethanol, and mixtures thereof.

21. The process according to claim 20, wherein said solvent is a mixture of water and ethanol in the range of from about 95:5 to about 20:80 water to ethanol by volume.

22. The process according to claim 21, wherein said solvent is a mixture of water and ethanol in the ratio of from about 1 to 1 by volume to about 1 to 3 by volume.

23. The process according to claim 20, wherein said solvent is water.

24. The process according to claim 23, wherein the water is used to produce said crude plant extract at a temperature of about 20° C. to about 90° C.

25. The process according to claim 24, wherein the water is used to produce said crude plant extract at a temperature of about 75° C. to about 90° C.

26. The process according to claim 21, wherein the water-ethanol mixture is used to produce said crude plant extract at a temperature of about 20° C. to 65° C.

27. The process according to claim 26 wherein the water-ethanol mixture is used to produce said crude plant extract at a temperature of about 25° C. to about 40° C.

28. The process according to claim 1, wherein said crude plant extract of step (a) is concentrated in step (b) by a method selected from the group consisting of distillation, reverse osmosis, microfiltration, ultrafiltration, nanofiltration, hollow fiber diafiltration, and any combination thereof.

29. The process according to claim 3, wherein said size exclusion chromatography process of step (c) is selected from the group consisting of gel filtration chromatography and gel permeation chromatography, and said plant extract fractions are concentrated in step (e) by a method selected from the group consisting of reverse osmosis, microfiltration, ultrafiltration, nanofiltration, hollow fiber diafiltration and any combination thereof.

30. The process according to claim 29, wherein said size exclusion chromatography process is gel filtration chromatography and uses a column packing selected from the group consisting of neutral cross-linked dextran and polyacrylamide gels.

31. The process according to claim 30, wherein said column packing is a neutral cross-linked dextran having a nominal exclusion limit of 700 Daltons.

32. The process according to claim 1, wherein said size exclusion process of step (c) uses an eluant selected from the group consisting of water, ethanol, and any combination thereof.

33. The process according to claim 32, wherein said eluant is water.

34. The process according to claim 29, wherein said size exclusion process is performed at a temperature in the range of about 20° C. to about 27° C.

35. The process according to claim 1, wherein prior to isolating said fraction of plant extract by said size exclusion process of step (c), said extract is adjusted to ambient temperature.

36. The process according to claim 6, wherein said ion-exchange material comprises a cation exchange moiety selected from the group consisting of carboxymethyl, sulfopropyl, sulfonic acid or carboxylic acid.

37. The process according to claim 36, wherein said ion-exchange material comprises cross-linked dextran having carboxymethylcellulose substituent groups.

38. The process according to claim 36, wherein said ion-exchange material is used with an eluant selected from the group consisting of monovalent salts and NaOH.

39. The process according to claim 38, wherein said eluant is a 0.1 M NaOH solution.

40. The process according to claim 1, wherein said concentrated plant extract of step (b) has a total solids content of about 12% to 36% percent by weight.

41. The process according to claim 1, wherein said concentrated plant extract of step (b) has a total solids content of about 18% to 22% percent by weight.

42. The process according to claim 1, wherein prior to step (c), said concentrated plant extract is treated to remove insoluble material contained therein.

43. The process according to claim 42, wherein said treatment of concentrated plant extract for removing insoluble material comprises a sequential chilling treatment.

44. The process according to claim 42, wherein said treatment for removing insoluble material is sequential chilling, centrifugation and filtration.

45. The process according to claim 44, wherein said intermediate molecular weight fractions have a molecular weight in the range from about 1,000 Daltons to about 15,000 Daltons.

46. The process according to claim 45, wherein said intermediate molecular weight fractions have a molecular weight in the range from about 1,500 Daltons to about 5,000 Daltons.

47. The process according to claim 42, wherein said treatment of concentrated plant extract for removing insoluble material comprises a precipitation and decantation treatment.

48. The process according to claim 42, wherein said treatment of concentrated plant extract for removing insoluble material comprises a centrifugation treatment.

49. The process according to claim 42, wherein said treatment of concentrated plant extract for removing insoluble material comprises a centrifugation and filtration treatment.

50. The process according to claim 42, wherein said treatment of concentrated plant extract for removing insoluble material comprises a filtration treatment.

51. The process according to claim 30, wherein said column packing is a polyacrylamide gel having a molecular weight fractionation range/nominal exclusion limit of about 100 to about 1,800 Daltons.

52. The process according to claim 1, wherein said intermediate molecular weight fractions have a molecular weight in the range from about 1,000 Daltons to about 15,000 Daltons.

53. The process according to claim 52, wherein said intermediate molecular weight fractions have a molecular weight in the range from about 1,500 Daltons to about 5,000 Daltons.

54. The process according to claim 37, wherein the ion exchange material has a molecular weight fractionation range/nominal exclusion limit of about 1,000 to about 5,000 Daltons.

55. The process according to claim 6, wherein said ion-exchange material comprises cellulose having carboxymethylcellulose substituent groups.

56. The process according to claim 6, wherein said ion-exchange material comprises polystyrene having sulfonic acid substituent groups.

57. The process according to claim 6, wherein said ion-exchange material comprises polystyrene having carboxylic acid substituent groups.

58. The process according to claim 37, wherein said ion-exchange material is a microporous bead-former cation exchanger comprising a cross-linked dextran gel having carboxymethyl substituent groups.

59. A process for producing and isolating intermediate molecular weight fractions from plant extracts, which fractions are stable and non-volatile under ambient temperature conditions and are useful as flavoring agents, comprising:

(a) contacting plant matter with a solvent to produce a crude plant extract;

(b) concentrating said crude plant extract;

(c) subjecting said concentrated crude plant extract to a size exclusion process by fractionating said concentrated crude plant extract into a series of fractionated plant extracts, said extracts falling within a range of intermediate molecular weight fraction of equal to or greater than approximately 600 Daltons and equal to or less than approximately 100,000 Daltons; and (d) isolating said fractionated plant extracts into fractions including said intermediate molecular weight fractions by using a suitable detection method to detect when said intermediate molecular weight fractions have been eluted from said size exclusion process and to trigger a fraction collection means in order to collect said isolated intermediate molecular weight fractions.

60. The process according to claim 1 or 6, wherein under thermal conditions, the isolated intermediate molecular weight fractions release aroma or flavors.

* * * * *